United States Patent [19]

Djordjevic

[11] Patent Number: 4,685,433

[45] Date of Patent: Aug. 11, 1987

[54] RPM GOVERNOR FOR FUEL INJECTION PUMPS

[75] Inventor: Ilija Djordjevic, Windsor, Conn.

[73] Assignee: Robert Bosch GmbH, Stuttgart, Fed. Rep. of Germany

[21] Appl. No.: 764,694

[22] Filed: Aug. 12, 1985

[30] Foreign Application Priority Data

Oct. 1, 1984 [DE] Fed. Rep. of Germany ..... 3435986

[51] Int. Cl.[4] ..... F02M 39/00

[52] U.S. Cl. ..... 123/373; 123/357; 123/449

[58] Field of Search ..... 123/373, 449, 357–359, 123/365, 385–387

[56] References Cited

U.S. PATENT DOCUMENTS

| | | | |
|---|---|---|---|
| 4,239,025 | 12/1980 | Konrath | 123/387 |
| 4,318,378 | 3/1982 | Eheim | 123/373 |
| 4,445,476 | 5/1984 | Eheim | 123/387 |
| 4,526,146 | 7/1985 | Djordjevic | 123/357 |

FOREIGN PATENT DOCUMENTS

| | | | |
|---|---|---|---|
| 1911913 | 9/1970 | Fed. Rep. of Germany | 123/387 |
| 3237499 | 4/1984 | Fed. Rep. of Germany | 123/357 |
| 0067932 | 4/1983 | Japan | 123/357 |
| 0074336 | 4/1984 | Japan | 123/357 |

*Primary Examiner*—Carl Stuart Miller

*Attorney, Agent, or Firm*—Edwin E. Greigg

[57] ABSTRACT

An rpm governor for fuel injection pumps of internal combustion engines, in which a control motor triggered via an electronic control unit processing parameters actuates a quantity control member of the injection pump via a pivotable governor lever. The governor lever is embodied in two parts, and the two parts are joined by a hinge and the lever part that is connected to the quantity control member is engaged by a spring in the direction of a decreasing injection quantity. The other lever part cooperates with the control motor and a pivot stop. As soon as the governor lever strikes the stop, the hinge yields, causing a change in the lever ratio and thus in the adjusting movement between the control motor and the quantity control member.

20 Claims, 7 Drawing Figures

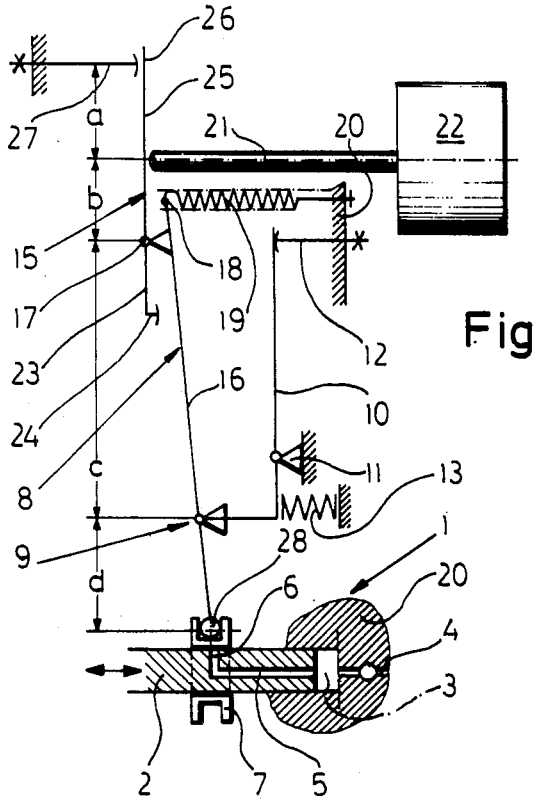
Fig. 1
Fig. 2
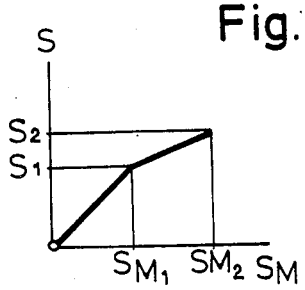

RPM GOVERNOR FOR FUEL INJECTION PUMPS

BACKGROUND OF THE INVENTION

The invention is based on an rpm governor for fuel injection pumps as defined hereinafter. In a known rpm governor of this kind (German Offenlegungsschrift No. 2 845 095), the adjusting movement of the quantity control member corresponds to the controlled variable of the adjusting motor, so that during normal quantity regulation, especially in the idling range, the adjusting motor must take very small adjusting steps; contrarily, at the breakaway point or at the transition from starting to the normal load range, very fast displacements of the quantity control member are needed. While a relatively low-powered adjusting motor is sufficient for the normal regulating range and the fine translation required in that range, a correspondingly more powerful as well as larger motor is needed for the breakaway and starting range and for the large steps required at that time. For instance, if a stepping motor is used, then the linear force (torque) of the stepping motor is directly related to the frequency, so that a very high frequency range, up to more than one kHz, is used for this kind of fully-electric governor. As a consequence, the motor is relatively expensive, and the energy reserve, something which must already be managed very sparingly in a motor vehicle, is subjected to increased demands.

OBJECT AND SUMMARY OF THE INVENTION

The speed governor according to the invention has the advantage over the prior art that because of the varying translation at the governor lever, a small adjusting motor is sufficient for the rapid displacements required during starting and breakaway regulation, and in the normal speed and load range this motor can effect the fine adjusting steps of the quantity control member without recourse to the translation provided according to the invention.

According to an advantageous embodiment of the invention, the governor lever comprises a first part which cooperates with the stop and the adjusting motor, and a second part which cooperates with the quantity control member; the parts are joined by a hinge, and the rotational movement of the parts relative to one another is limited in a kind of drag function. One of the two governor lever parts may be embodied in two parts with respect to the hinge, with a first arm together with the other governor lever part forming a rotation stop which limits rotational movement in the direction of a decreasing quantity. While in the normal regulation range, because of the spring, the first and second parts of the governor lever and the contract with the rotation stop form an adjusting unit, the rotation stop lifts away as soon as the first governor lever part strikes the pivot stop, and a bend in the governor lever is produced at the hinge point. As a result, there is a lever reduction; that is, at the same control variable, the adjusting motor brings about a longer adjusting movement of the quantity control member than before. Since the distance between the stop location and the point where the adjusting motor intervenes is longer for the first lever part than the distance between the adjusting motor intervention point and the hinge, there is a force increase, for the first lever part, of the adjusting motor force exerted on the quantity control member, so that the longer adjustment movements and the larger acceleration forces then required are now available. By means of this variable translation, a fine gradation of quantity control is attained for idling, and a high adjusting speed is attained, although with a coarser adjustment of quantity, for breakaway regulation or at the transition from starting rpm to idling rpm. Advantageously, small and inexpensive stepping motors having a low frequency can then be used.

The invention will be better understood and further objects and advantages thereof will become more apparent from the ensuing detailed description of preferred embodiments taken in conjunction with the drawings.

BRIEF DESCRIPTION OF THE DRAWINGS

In highly simplified form, the drawings illustrate two exemplary embodiments of the invention and a variant thereof.

FIG. 1 is a schematic illustration of the first exemplary embodiment;

FIG. 2 is a diagram for the adjusting travel of the adjusting motor and the quantity control member;

DESCRIPTION OF THE PREFERRED EMBODIMENTS

Figure 3:
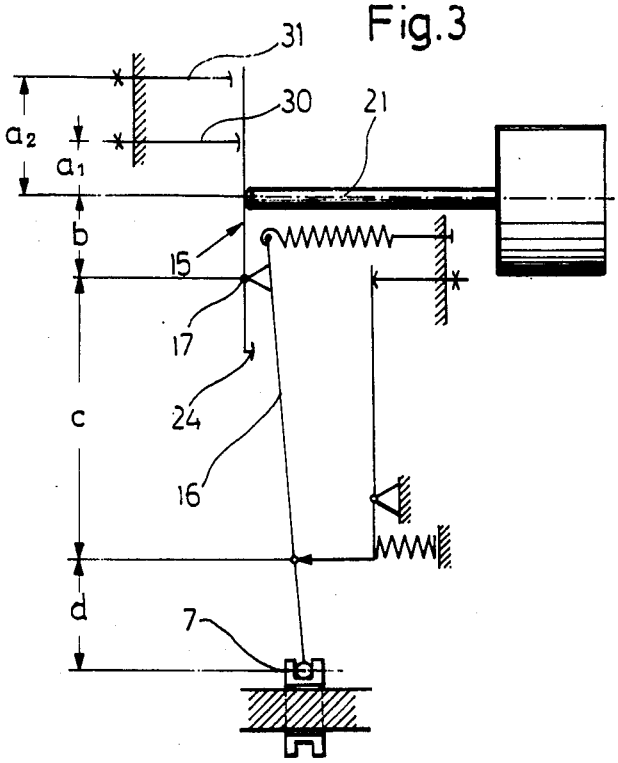
FIG. 3 shows a variant of the first exemplary embodiment shown in FIG. 1, with two pivot stops.

In a fuel injection pump 1 shown only schematically, a pump piston 2 is set into at least a reciprocating motion by means not shown, and the pump piston 2 pumps fuel to the internal combustion engine via a pressure line 4 from a pump work chamber 3 during its compression stroke until such time as a relief bore 5 of this pump work chamber 3 emerges with its radial outlet 6 from an annular slide 7 serving as a quantity control member, which is disposed axially displaceably about the pump piston 2. Depending on the position of the annular slide 7, the outlet 6 is opened earlier or later, which corresponds to a smaller or larger injection quantity. For increased starting quantities, the annular slide 7 is accordingly displaced the farthest toward the right, while contrarily during idling and at low load it is displaced as far as possible to the left all of which is believed to be clear from the drawing.

The annular slide 7 is articulated by a governor lever 8, which is pivotable about a shaft 9, which is supported in turn by an adjusting lever 10, which is supported on a stationary adjusting shaft 11 and is adjustable by means of an adjusting screw 12 counter to the force of a retaining spring 13. As the adjusting screw 12 is controlled, the pivot shaft 9 is correspondingly adjusted as the governor adapts to the injection pump or to the engine.

The governor lever 8 comprises two parts, a first part 15 and a second part 16, which are connected to one another via a hinge 17. The free end 18 of the second lever part 16 is engaged by a spring 19, which tends to pull the annular slide 7 in the direction for smaller injection quantities. With its end remote from the free lever end 18, the spring 19 is suspended on the housing 20 of the governor or of the pump. The first lever part 15 is engaged by the adjusting member 21 of an electric control motor 22, the adjusting travel $S_M$ of which, corresponding to the engine control variable, corresponds to the adjusting travel s of the annular slide 7. The control motor 22 is triggered by an electronic control unit which processes engine parameters and environmental parameters. The first lever part 15 is embodied with two arms: a first arm 23 on the free end of which a stop 24, which cooperates with the second lever part 16 upon a corresponding rotational position of the first lever part 15, is provided, and a second arm 25, which is engaged by the adjusting member 21 of the control motor 22 and the free end 26 of which cooperates with a pivot stop 27. This pivot stop 27 is adjustable.

OPERATION

The lever ratio now results in the following adjusting travel proportion. If the distance between the stop 27 and the engagement point of the adjusting member 21 is defined as a, the distance between the engagement point of the adjusting member 21 and the hinge 17 is defined as b, the distance between the hinge 17 and the pivot shaft 9 is defined as c and the distance between the pivot shaft 9 and the quantity control member articulation point 28 is defined as d, then for normal operation and idling rpm, a lever radio of $l_n=(b+c/d)$ always results, whenever the stop 24 is resting on the second lever part 16. Then as soon as the lever has been displaced by the control motor 22 so far in the direction of increasing injection quantity, because of the adjusting travel $s_m$ of the adjusting member 21, that the end 26 of the first lever part 15 strikes the stop 27, the stop 24 lifts from the second lever part 16, resulting in the following lever ratio: $l_s=(a.c/d(a+b)$. For the adjusting travels associated with the lever ratios, the numerator corresponds to the adjusting travel $s_m$ of the adjusting member 21, that is, to the control variable of the motor 22 and the denominator corresponds to the adjusting travel s of the quantity control member 7. As will readily be appreciated, a specific adjusting variable $s_m$ of the adjusting member 21 during idling and normal operation effects a correspondingly slight displacement of the annular slide 7, as compared to when during starting or full-load operation, as shown, the rotation stop 24 is lifted to the illustrated distance s.

In FIG. 2, the adjusting travel s of the annular slide 7 is shown on the ordinate, and the adjusting travel $s_m$ of the adjusting member 21 is shown on the abscissa. Up to the point $s_{m1}$ the stop 24 is lifted up from the second lever part 16, so that in accordance with the lever ratio, the annular slide 7 undergoes a correspondingly large adjustment per unit of travel of the adjusting member 21. From this point $s_{m1}$ on, however, this lever ratio takes a substantially flatter course, that is, up to point $s_{m2}$ which corresponds to a travel $s_2$ of the annular slide 7. As shown in the diagram, the distance between $s_1$ and $s_2$ is less than half as long as the distance between $s_1$ and the origin 0, while the distances between $s_{m2}$ and $s_{m1}$ and $s_{m1}$ and the origin are approximately equal; that is, at an equal adjustment of the adjusting member 21 from the point the stop 24 strikes the second lever part 16, the corresponding adjusting movement of the annular slide 7 in fact takes a very much slower course, intended for the normal and the idling rpm range.

In the variant shown in FIG. 3, the only difference is that two pivot stops 30 and 31 are provided. While the pivot stop 30 serves the purpose of starting breakaway regulation, the pivot stop 31 serves for fullload breakaway regulation. The distances from the engagement point of the adjusting member 21 here are defined as $a_1$for the starting stop 30 and $a_2$ for the full-load stop 31. As a result, the lever ratio is subdivided again in the range in which the stop 24 has lifted from the second lever part 16, so that after a very steep breakaway regulation after starting rpm, a somewhat flatter course for full-load breakaway regulation follows, which is then followed by the normal governing range. Depending on the rotational position of the first lever part 15 or the pivoted position of the second lever part 16 and thus the position of the hinge 17, either one or the other pivot stop 30, 31 can come into engagement.

Figure 4:
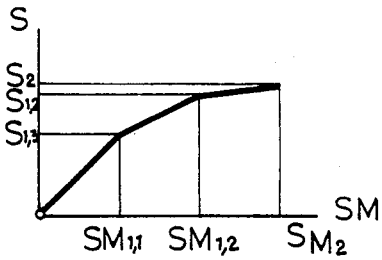
FIG. 4 is an adjusting travel diagram for this variant.

The flattening of these lever ratios and thus of the adjusting movements in the ratio of the adjusting member 21 to the annular slide 7 is expressed in the diagram in FIG. 4. Here again, the adjusting travel of the annular slide 7 is plotted on the ordinate, and the adjusting travel of the adjusting member 21 is plotted on the abscissa. The travels of the annular slide 7 from the origin 0 for starting up to $s_1$, 1 and from there for the full-load breakaway regulation with $s_1$, 2 up to beyond the normal governing range with $s_2$ correspond to the increments of the adjusting member 21 for starting from the origin 0 to $s_{m1}$, 1 and from there for full load to $s_{m1}$, 2 and from there for the idling and normal rpm range to $s_{m2}$. While for the first two increments the stop 24 has lifted up from the second lever part 16, for the third and correspondingly flat increment it rests on this second lever part 16.

Figure 5:
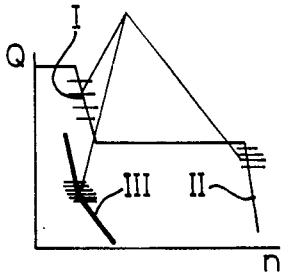
FIG. 5 is a quantity/rpm function diagram for this variant.
Figure 6:
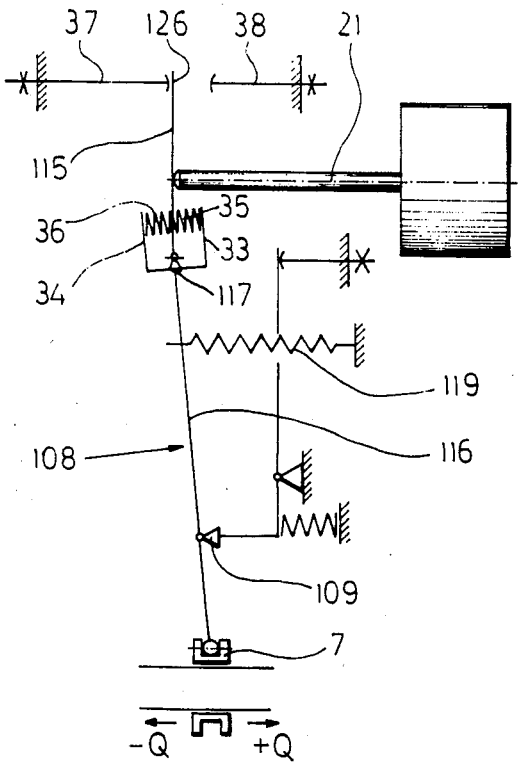
FIG. 6 shows schematically the second exemplary embodiment.

A corresponding situation wil be appreciated from the quantity/rpm diagram of FIG. 6, in which the injection quantity Q is plotted on the ordinate and the rpm n is plotted on the abscissa. The horizontal marks on the curves indicate the differences in injection quantities resulting from the adjusting movement of the annular slide 7 for the three different situations, that is, starting breakaway regulation I, full-load breakaway regulation II and normal regulation, especially idling, III. Each of these quite different quantity variations corresponds to a uniform increment or adjusting travel of the adjusting member 21; in other words, given a uniform subdivision of the adjusting travel of the adjusting member 21 into individual increments, one of the partial injection quantities, defined by the divisions indicated by the horizontal marks in FIG. 5, corresponds to each increment. According to the invention, these partial injections quantities differ considerably from one another between starting, full-load and idling regulation.

In the second exemplary embodiment shown in FIG. 6, the spring 119 engages the second lever part 116 between the hinge 117 and the pivot shaft 109. From this pivot point 117 on, the second lever part 116 is forked and has two arms 33 and 34, on which springs 35 and 36 fastened between the first lever part 115 are supported. The pivoting movement range of the free end 126 of this first lever part 115 is limited by two pivot stops 37 and 38.

Figure 7:
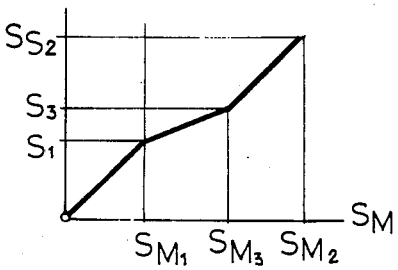
FIG. 7 is an adjusting travel diagram of the governor according to FIG. 5.

From the adjusting travel diagram of FIG. 7, in which again the travel of the annular slide 7 is plotted on the ordinate and the travel of the adjusting member 21 is plotted on the abcissa, the course of the lever ratio of this second exemplary embodiment can be learned. In the breakaway regulation of starting rpm, at which the first lever part 116 is resting on the stop 37, for the stroke $S_{M1}$ the travel of the annular slide 7 extends analogously up to the stroke $s_1$. Upon further displacement of the adjusting member 21 (in the drawing, toward the right) the end 126 of the first lever 115 lifts from the stop 37, which causes a flattening of the lever ratio, so that for this full-load breakaway range, at the same travel $s_{M3}$ the annular slide travel from $s_1$ to $s_2$ is relatively short. After this full-load translation, the free end 126 of the first lever 115 strikes the stop 38, which determines a ratio for the remaining governor travel, which extends approximately as steeply as at starting rpm. Here a virtually equally long travel of the annular slide 7 corresponds to a travel of the adjusting member 21 from $s_{M3}$ to $s_{M2}$. As soon as this first lever 115 strikes one of the stops 37, 38, one of the springs 35, 36 is compressed, and the other is able to expand; however, a restoring force into the central position is present, for the range in which the first lever part 115 is freely movable between the stops 37 and 38.

What this second exemplary embodiment is intended particularly to illustrate is that by means of variable lever ratios and stop arrangements, different translation ratios are also brought about, by means of which virtually every problem in this respect can be solved.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An rpm governor for fuel injection pumps of internal combustion engines, comprising an electric control motor triggered via a parameter processing electronic control unit including a quantity control member which determines the injection quantity, said quantity control member being actuated by said control motor, a governor lever arranged to transmit a control variable of said control motor to said quantity control member, said governor lever being pivotable about a shaft and adapted to be urged in an adjusting direction of decreasing injection quantity by a spring, said governor lever further including first and second lever parts, said second lever part being adapted to cooperate with said quantity control member, said first lever part being pivotable about a hinge on said second lever part and further being adapted to cooperate with a stationary pivot stop and being directly acted upon by said control motor between said hinge and an abutment point of said pivot stop, the said first lever part having coupling means adapted to establish in one selected pivot range of said second lever part a rigid connection to said second lever part up to a pivot angle where abutment of said first lever part to said pivot stop occurs.

2. An rpm governor as defined by claim 1, further wherein a rotational movement of said second lever part relative to said first lever part is limitable.

3. An rpm governor as defined by claim 1, further wherein said pivot shaft of said governor lever has a position which is variable for the purpose of adjustment.

4. An rpm governor as defined by claim 2, further wherein said pivot shaft of said governor lever has a position which is variable for the purpose of adjustment.

5. An rpm governor as defined by claim 3, further wherein said pivot shaft is disposed on an adjusting lever, said adjusting lever being pivotable about an adjusting shaft.

6. An rpm governor as defined by claim 2, further wherein at least one of said first and second lever part of said governor lever comprises two arms correlated with said hinge means and further that a first arm together with said other governor lever part forms a rotation stop thereby limiting the rotational movement thereof in the direction of decreasing injection quantity.

7. An rpm governor as defined by claim 3, further wherein at least one of said first and second lever part of said governor lever comprises two arms correlated with said hinge means and further that a first arm together with said other governor lever part forms a rotation stop thereby limiting the rotational movement thereof in the direction of decreasing injection quantity.

8. An rpm governor as defined by claim 4, further wherein at least one of said first and second lever part of said governor lever comprises two arms correlated with said hinge means and further that a first arm together with said other governor lever part forms a rotation stop thereby limiting the rotational movement thereof in the direction of decreasing injection quantity.

9. An rpm governor as defined by claim 5, further wherein at least one of said first and second lever part of said governor lever comprised two arms correlated with said hinge means and further that a first arm together with said other governor lever part forms a rotation stop thereby limiting the rotational movement thereof in the direction of decreasing injection quantity.

10. An rpm governor as defined by claim 6, further wherein said first governor lever part comprises two arms, and said control motor and said pivot stop are arranged to act upon said second arm of said first lever part.

11. An rpm governor as defined by claim 6, further wherein said second governor lever part comprises two arms.

12. An rpm governor as defined by claim 9, further wherein the relative rotational movement of said governor lever parts in the direction of an increasing quantity is limitable by means of an additional rotation stop.

13. An rpm governor as defined by claim 10, further wherein the relative rotational movement of said governor lever parts in the direction of an increasing quantity is limitable by means of an additional rotation stop.

14. An rpm governor as defined by claim 11, further wherein the relative rotational movement of said governor lever parts in the direction of an increasing quantity is limitable by means of an additional rotation stop.

15. An rpm governor as defined by claim 6, further wherein said first lever part of said governor lever further includes spring means that cooperate with means carried by said second lever part.

16. An rpm governor as defined by claim 10, further wherein said first lever part of said governor lever further includes spring means that cooperate with means carried by said second lever part.

17. An rpm governor as defined by claim 11, further wherein said first lever part of said governor lever further includes spring means that cooperate with means carried by said second lever part.

18. An rpm governor as defined by claim 12, further wherein said first lever part of said governor lever further includes spring means that cooperate with means carried by said second lever part.

19. An rpm governor as defined by claim 1, further wherein said pivot stop is adjustable.

20. An rpm governor as defined by claim 1, further wherein said pivot stop comprises plural means each said means serving to attain a different ratio.

* * * * *